US011136990B2

(12) United States Patent
Kraner et al.

(10) Patent No.: US 11,136,990 B2
(45) Date of Patent: Oct. 5, 2021

(54) EDGE DESIGN OF A ROTATION ELEMENT AND IMPELLER

(71) Applicant: ebm-papst Mulfingen GmbH & Co. KG, Mulfingen (DE)

(72) Inventors: Denis Kraner, Bad Mergentheim (DE); Thomas Heli, Langenburg (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 465 days.

(21) Appl. No.: 15/353,046

(22) Filed: Nov. 16, 2016

(65) Prior Publication Data

US 2017/0175777 A1 Jun. 22, 2017

(30) Foreign Application Priority Data

Dec. 17, 2015 (DE) ..... 10 2015 122 132.2

(51) Int. Cl.
*F04D 29/30* (2006.01)
*F04D 29/28* (2006.01)

(52) U.S. Cl.
CPC ..... *F04D 29/30* (2013.01); *F04D 29/281* (2013.01)

(58) Field of Classification Search
CPC ..... F04D 29/30; F04D 29/281; F04D 29/703; F04D 29/283
See application file for complete search history.

(56) References Cited

U.S. PATENT DOCUMENTS 6,685,433 B2 * 2/2004 Kim ..... F04D 29/282 415/206
7,618,239 B2 * 11/2009 Hatsugai ..... F04D 29/666 416/185
8,807,949 B2 * 8/2014 Hammel ..... F04D 29/662 416/144
8,870,541 B2 * 10/2014 Imahigashi ..... F04D 29/30 416/187

FOREIGN PATENT DOCUMENTS

EP 2366907 A2 9/2011
GB 517293 A * 1/1940 ..... F04D 29/281

* cited by examiner

*Primary Examiner* — David Hamaoui
*Assistant Examiner* — John S Hunter, Jr.
(74) *Attorney, Agent, or Firm* — Harness, Dickey & Pierce, P.L.C.

(57) ABSTRACT

The impeller has a bottom disk, a top disk, and impeller blades sandwiched between the two. The top disk has an inner opening edge that defines an axial inlet opening. The impeller blades have a first radial inward section that extends radially inward beyond the opening edge. A blade contour on each impeller blade points toward the inlet side of the impeller. The blade contour first radial inward section extends from a transition portion near the opening edge under the top disk. The blade contour on the first radially inward section of the impeller blade extends radially inward yond the opening edge and forms a specified formula geometrical edge design. A second portion of the impeller blades extends radially outward from the transition portion, the transition portion and the second portion of the impeller blade are covered entirely by the top disk from the first formula impeller blade contour.

7 Claims, 3 Drawing Sheets

EDGE DESIGN OF A ROTATION ELEMENT AND IMPELLER

CROSS-REFERENCE TO RELATED APPLICATIONS

This application claims the benefit and priority of DE 102015 122 132.2, filed Dec. 17, 2015. The entire disclosure of the above application is incorporated herein by reference.

FIELD

The disclosure concerns an edge design of a rotation element of an air movement device, especially an impeller, in order to reduce particle adherence. Moreover, the disclosure concerns an impeller for fans with a special impeller blade contour to reduce particle adherence onto the impeller and especially the impeller blades during operation.

BACKGROUND

Impellers of this kind are known from the prior art and are disclosed for example in publication EP 2 366 907 A2.

Such impellers have been optimized in terms of their geometry and especially in terms of the blade configuration such that the air flow is guided with high efficiency and little noise production. During operation, however, particles of dust or lint can adhere to them and have negative impact on these parameters.

SUMMARY

This section provides a general summary of the disclosure, and is not a comprehensive disclosure of its full scope or all of its features.

The disclosure now modifies the known air movement devices, especially impellers, in regard to their geometry. Therefore, the problem the disclosure proposes to solve is to provide an edge design, of a rotation element, that minimizes particle adherence during operation. Furthermore, an impeller is proposed with an impeller blade geometry that minimizes particle adherence during operation.

According to the disclosure, an edge design of a rotation element of an air movement device, especially an impeller, is proposed. The rotation element has an axial extension parallel to the axis of rotation. It delivers an air volume during operation. The edge design is configured geometrically as determined by the formula $$f(x)=n*(0.025*x^2-0.8*x+c).$$

where n and x are defined as $3 \leq n \leq 1/3$, $d \leq x \leq d/50$, d corresponds to a diameter of the air movement device or impeller and c is a variable number.

The edge design is a free-standing edge of the air movement device that interacts with the moving air volume during operation.

Part of the disclosure is the use of the above-described edge design on at least one edge of the impeller blades of the impeller. The edge preferably points toward an inlet side of the impeller and determines the blade contour.

Moreover, the disclosure involves an impeller with an axial inlet side as well as several impeller blades spaced apart in the circumferential direction. The impeller blades extend for at least a section in the radial direction. The impeller blades have a blade contour that increases at least partly radially outward as seen in the radial cross section.

The blade contour points toward the inlet side. The edge design is dictated by the formula $$f(x)=n*(0.025*x^2-0.8*x+c).$$

Here, n defines a corridor of variation and lies in a value range of $3 \leq n \leq ⅓$, d defines a diameter of the impeller and c is a variable number, x lies in a range of $d \leq x \leq d/50$.

The variable c does not influence the curve of the blade contour. Rather it only determines the height of the blade contour pointing toward the inlet side on the ordinate in the system of coordinates. The value for c is therefore entirely arbitrary.

The value range for the parameter n spans a corridor of two curves, within which the curve of the blade contour lies.

The specific blade contour of the impeller blade pointing toward the inlet side generates a flow that reduces the particle adherence during operation by 25-50%. The critical factor here, among others, is the slight axial extension of the impeller blade in the radially inner section with the radially outward enlargement necessarily dictated by the formula.

In one advantageous configuration variant, the impeller blades have the blade contour over at least 40% of its total extension in the radial direction. Due to the special curve form, over such a substantial portion of the length of the impeller blade, the particle adherence is effectively reduced. Furthermore, a configuration is advantageous where the impeller blades have the blade contour at least in a radially inward situated section that extends radially outward, starting from its radially inward situated end.

In one modification, the impeller blades, in the circumferential direction, are at least curved in one direction, especially in an arc. Insofar as a "radial extension" of the impeller blade is mentioned, this refers, in the case of curved impeller blades, to the extension in the radial direction and circumferential direction from radially inward to radially outward.

In one embodiment, the impeller has a hub conically tapering to the inlet side in the axial direction. The impeller blades are attached to the hub with a radial spacing. The conically tapering hub and the impeller blades thus stand in an operative fluidic connection.

Furthermore, the impeller preferably comprises a bottom disk. The impeller blades are fashioned on the disk as a single piece. The bottom disk and the hub pass into each other directly and flush in the radial direction. Furthermore, the bottom disk, in one embodiment, continues the conical extension of the hub. The bottom disk has an axial enlargement in the region bordering the hub on the radial inside. The impeller blades, in one sample configuration, are provided only in the region of the bottom disk.

In one modification, a top disk is arranged on the impeller. It is axially opposite the bottom disk. The impeller blades extend axially between the bottom disk and top disk and form the corresponding spacing. The top disk extends both in the radial and the axial direction. In one embodiment, the top disk forms an axial inlet opening with an inner opening edge.

A configuration is advantageous where the impeller blades extend in an axial top view inwards in the radial direction beyond the opening edge. In other words, the diameter of the inlet opening is so large that the impeller blades, when looking into the inlet opening, extend radially inwards beyond the opening edge.

Consequently, the diameter of the inlet opening is larger than the diameter of the hub. The special blade contour, dictated by the formula, is provided especially in the region extending in the radial direction inwards beyond the opening edge of the inlet opening.

Moreover, a configuration variant of the impeller is favorable where an axial extension of the impeller blades, at their respective radial inner end, passes continuously into a surface of the bottom disk. The impeller blades become increasingly shorter in the radially inward axial direction until they merge with the bottom disk. In this case, the curve of the blade contour of the impeller blades, as defined by the formula, is provided in the region of the inlet opening. The particle adherence in the radially inward situation region is substantially reduced as a result. Furthermore, the material expense and thus the adherence surface presented by the impeller blades is minimal.

In another configuration variant, the impeller blades have their maximum axial extension at their respective radial outer edge section and merge flush with outer edges of the bottom disk and/or the top disk.

In another advantageous variant, the impeller is fashioned as a single piece and especially one of plastic. In this way, both the number of parts and the assembly expense are reduced.

The disclosure furthermore involves a fan with an impeller having the above described technical features.

All disclosed features can be combined in any way desired, so far as this is technically possible.

Other advantageous modifications of the disclosure explained more closely below together with the description of the preferred configuration of the disclosure with the aid of the figures.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
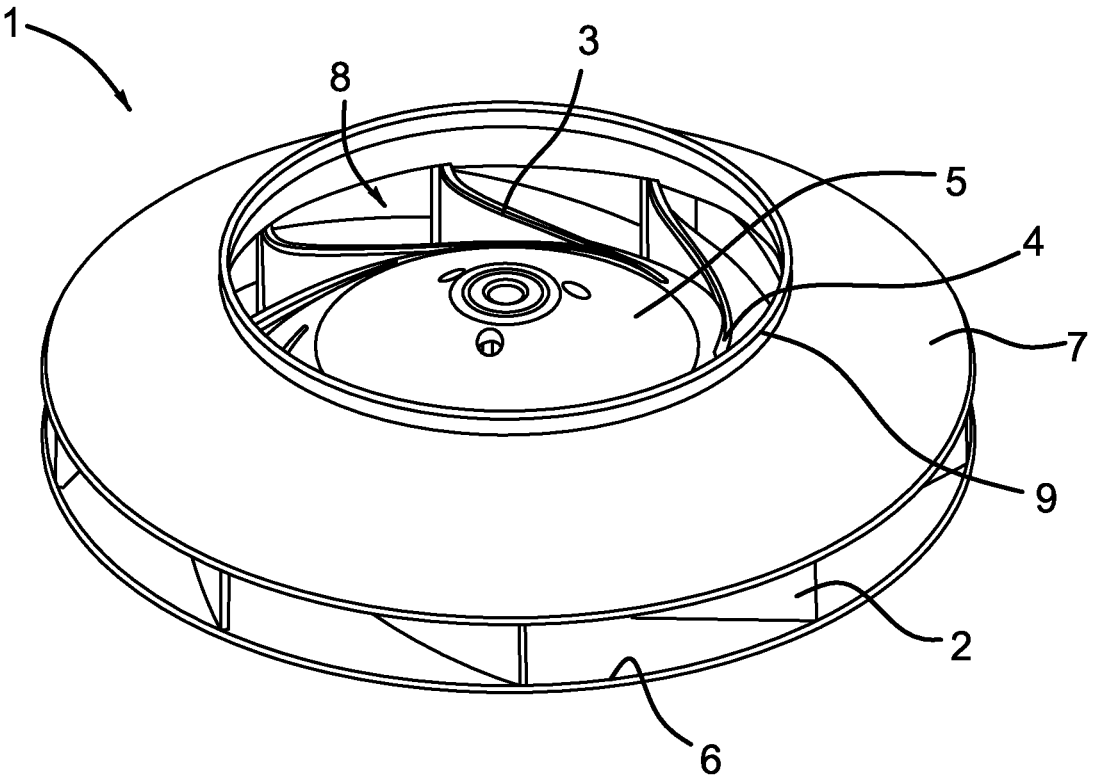
FIG. 1 is a perspective view of an impeller according to the invention.
Figure 2:
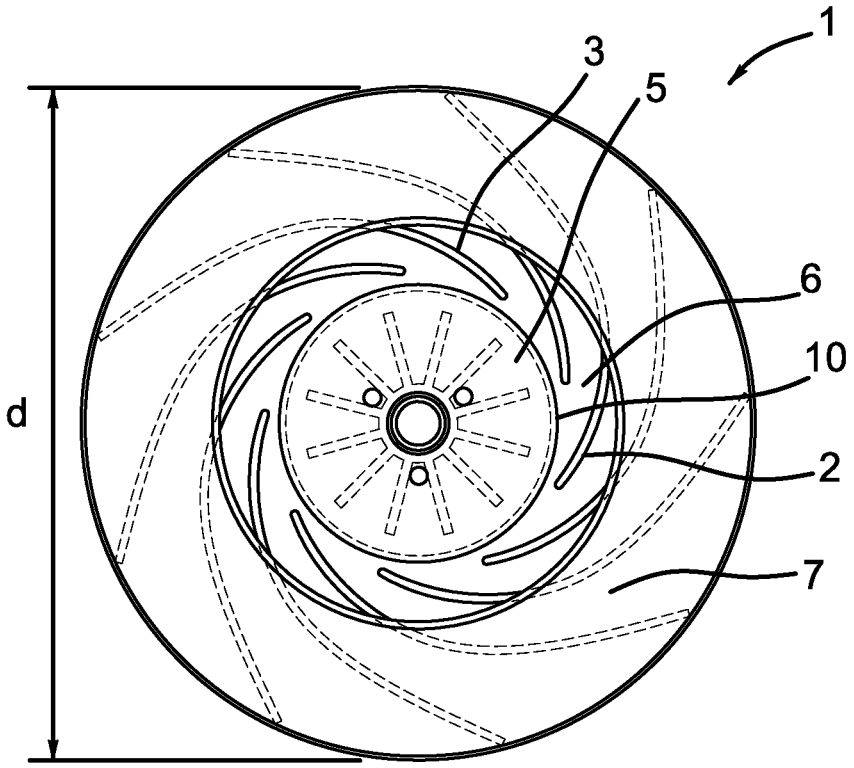
FIG. 2 is a top view of the impeller of FIG. 1.

FIGS. 1 and 2 show a sample configuration of an impeller 1 according to the disclosure with an edge design of the impeller blades 2 in a perspective view and in a top view. The impeller 1 is fashioned as a single piece. The bottom disk 6 and the top disk 7 are connected by the impeller blades 2 extending in the axial direction and curving in the circumferential direction. The bottom disk 6 and the top disk 7 merge flush with the radial outer edges of the impeller blades 2 and form the diameter d of the impeller 1. The top disk 7 has an inner opening edge 9 that dictates the size of the axial inlet opening 8 of the impeller 1. The impeller blades 2 extend inward in the radial direction beyond the opening edge 9, looking in the axial top view of FIG. 2.

The impeller blades 2 each have a blade contour 3 pointing toward the inlet side, geometrically forming an edge design according to the above-given formula with values $n=1$, $11 \leq x \leq 33$ and $c=0$. The corresponding shape of the impeller blades 2 starts from its radially inward situated end 4 and extends in the radially outward direction. Furthermore, a hub 5 is arranged on the impeller 1. The hub 5 conically tapers in the axial direction, passing into the bottom disk 6 at the hub edge 10. The impeller blades 2 are attached to the hub 5 with a spacing in the radial direction.

Figure 3:
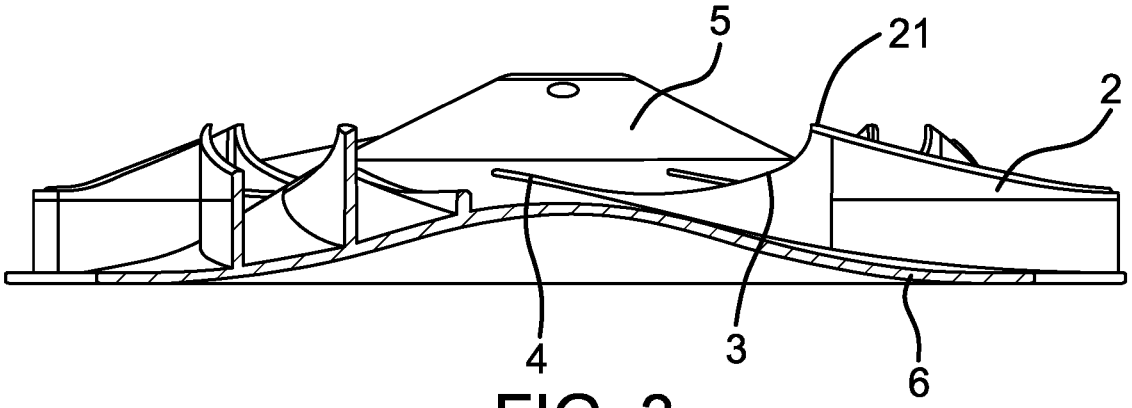
FIG. 3 is a partly opened-up side cross section view of the impeller of FIG. 1.
Figure 4:
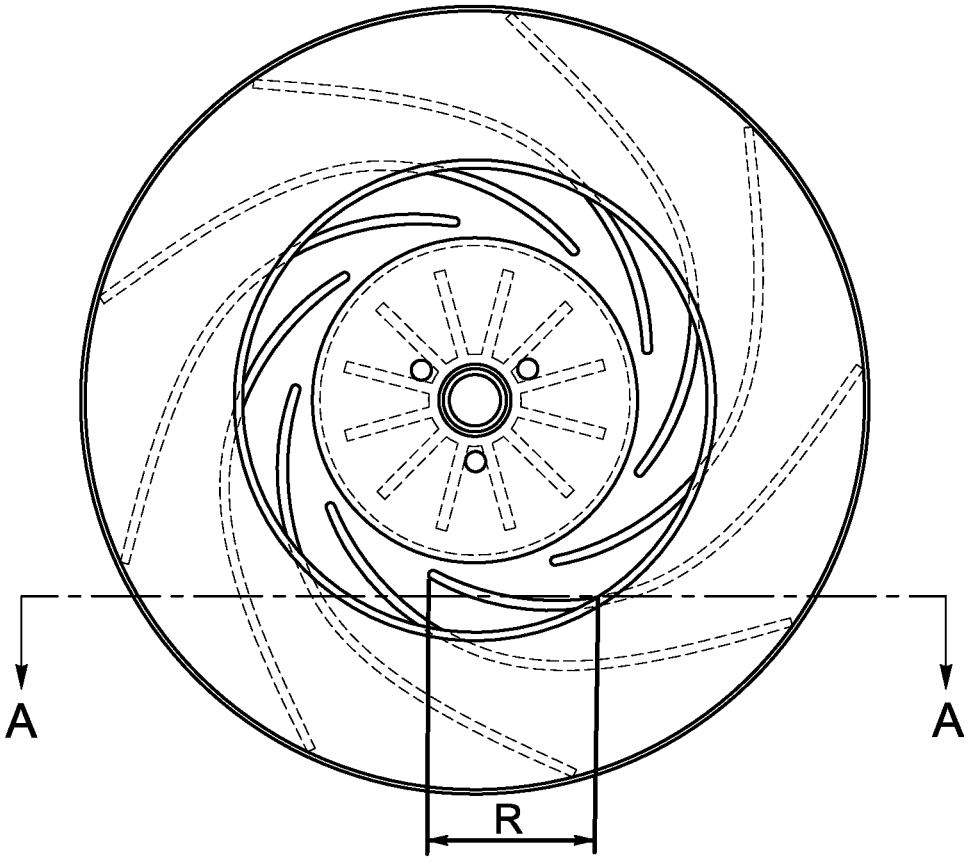
FIG. 4 is a representation of the blade contour in a projection to the impeller of FIG. 1.
Figure 5:
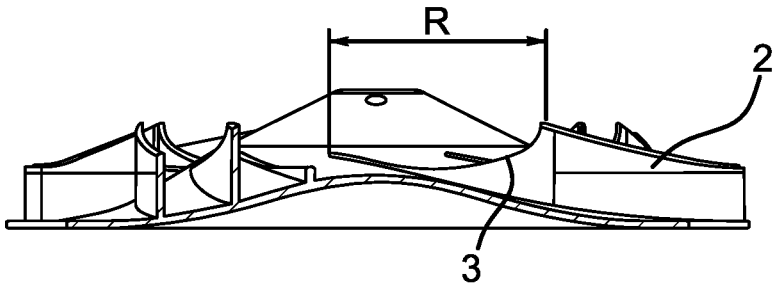
FIG. 5 is a cross-sectional view of FIG. 4 along line A-A thereof.
Figure 6:
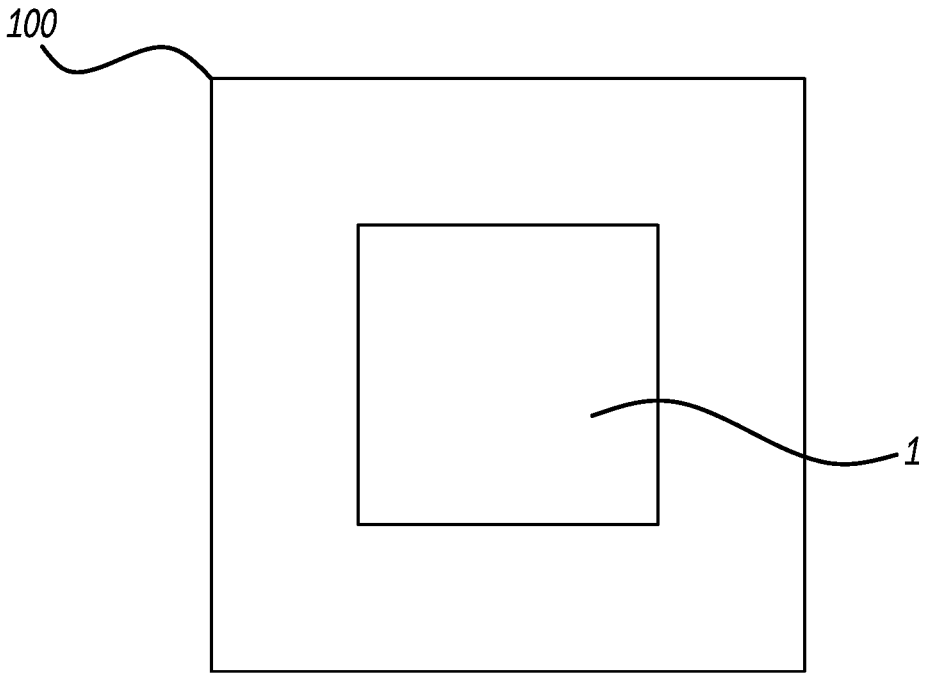
FIG. 6 is a schematic view of the fan 100 comprising the impeller 1 of FIG. 1.

FIG. 3 shows a partly broken-open radial cross section A-A of the impeller from FIG. 1 and FIG. 4. The top disk 7 has been removed in order to illustrate the blade contour 3. The edge design of the impeller blades 2 is in accordance with the above given formula in the radially inward section. In the adjoining region in the radial direction, that is entirely covered by the top disk 7, the blade contour 3 of the impeller blades 2 extends steadily decreasing substantially in the axial direction as far as the radial outer edge. The end of the blade contour 3 with the edge design of the impeller blades 2, according to the above given formula, looking in the radial direction, forms the tip 21. The tip 21, at the same time, forms the transition to the substantially constantly axially decreasing blade contour 3. The radially inward situated free ends 4 of the impeller blades 2 pass continuously into the surface of the bottom disk 6.

FIG. 4 provides a better comprehension of the blade contour 3 with the edge design of the impeller blades 2 according to the above given formula seen in a projection for the impeller of FIG. 1. The edge design, dictated by the formula, extends in the sample configuration shown along the blade contour 3 over a projected length R. The illustrated impeller 1 achieves a reduction of particle adherence of over 30% in measurements as compared to the impeller known from the prior art under identical ambient conditions.

The disclosure is not limited in its configuration to the above indicated preferred sample configurations. Instead, a number of variants are conceivable, that make use of the presented solution even in basically different configurations. For example, S-shaped impeller blades in an axial top view can also be used.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An impeller comprising:

a bottom disk;

a top disk, and impeller blades sandwiched between the bottom and top disks, the bottom and top disks merge flush with radial outer edges of the impeller blades forming a diameter (d) of the impeller, the top disk has an inner opening edge that defines an axial inlet opening, the impeller blades have a first radial inward section and a second radially outward portion that defines a radial length of the impeller blade in a radial direction, the first radial inward section extends radially inward beyond the opening edge;

a blade contour on each impeller blade, the blade contour points toward the inlet side of the impeller; the blade contour on the first radial inward section extends from a transition portion, the blade contour on the first radially inward section of the impeller blade that extends radially inward beyond the opening edge such that the blade contour on the first radial inward section extends radially over at least 40% of the length of the impeller blade along the radial direction and the blade contour on the first radially inward section geometrically forms an edge design by with a first formula blade contour of $$f(x)=n*(0.025*x^2-0.8*x+c)$$

where n is $3 \leq n \leq 1/3$ and $d \leq x \leq d/50$ and $11 \leq x \leq 33$ and c is a variable number and;

a second portion of the impeller blades extends radially outward from the transition portion, the transition portion and the second portion of the impeller blade are covered entirely by the top disk from the first formula impeller blade contour, which is covered by the top disk at the transition portion, to the radial outer edge of the impeller blade such that the second portion blade contour steadily decreases in an axial direction to the radial outer edge of the impeller blade.

2. The impeller according to claim 1, wherein the impeller has a hub conically tapering in the axial direction, the impeller blades are attached to the hub with a radial spacing.

3. The impeller according to claim 1, wherein the bottom disk and the impeller blades are a single piece construction.

4. The impeller according to claim 1, wherein an axial extension of the impeller blades at a respective radial inner end extends continuously into a surface of the bottom disk.

5. The impeller according to claim 1, wherein the impeller is of a single piece construction.

6. The impeller according to claim 1, further comprising a tip formed at the transition portion.

7. A fan comprising the impeller according to claim 1.

* * * * *